US011866919B2

(12) United States Patent
Pencheon

(10) Patent No.: US 11,866,919 B2
(45) Date of Patent: Jan. 9, 2024

(54) FILL VALVE WITH TANK

(71) Applicant: Vance Roy Pencheon, Basseterre (KN)

(72) Inventor: Vance Roy Pencheon, Basseterre (KN)

( * ) Notice: Subject to any disclaimer, the term of this patent is extended or adjusted under 35 U.S.C. 154(b) by 0 days.

(21) Appl. No.: 17/896,234

(22) Filed: Aug. 26, 2022

(65) Prior Publication Data

US 2023/0064785 A1 Mar. 2, 2023

Related U.S. Application Data

(60) Provisional application No. 63/239,364, filed on Aug. 31, 2021.

(51) Int. Cl.

| | |
|---|---|
| ***E03D 1/33*** | (2006.01) |
| ***E03D 1/30*** | (2006.01) |
| ***E03D 1/34*** | (2006.01) |

(52) U.S. Cl.

CPC ..... *E03D 1/33* (2013.01); *E03D 1/308* (2013.01); *E03D 1/34* (2013.01)

(58) Field of Classification Search

CPC .... E03D 1/32; E03D 1/33; E03D 1/34; E03D 1/308

USPC ..... 4/353, 415, 391–396, 427, 363, 366; 137/390, 441

See application file for complete search history.

(56) References Cited

U.S. PATENT DOCUMENTS 5,661,855 A * 9/1997 Osmond ..... E03D 1/00 4/415

5,862,537 A * 1/1999 Osmond ..... E03D 1/32 4/415

* cited by examiner

*Primary Examiner* — Tuan N Nguyen

(74) *Attorney, Agent, or Firm* — Gutwein Law; Tyler B. Droste

(57) ABSTRACT

An improved and redundant system to prevent leakage from a toilet tank and into a toilet bowl. The device comprises a housing configured to surround a float and including side-walls and bottom portion with a bore hole. A secondary flop is configured for receipt into and for sealing the bore hole when leakage occurs.

11 Claims, 4 Drawing Sheets

FILL VALVE WITH TANK

CROSS REFERENCE TO RELATED APPLICATIONS

This U.S. patent application claims priority to U.S. Provisional Patent Application No. 63/239,364 filed 31 Aug. 2021 to the above-named inventor of which the disclosure is considered part of the disclosure of this application and is herein incorporated by reference in its entirety.

FEDERALLY SPONSORED RESEARCH OR DEVELOPMENT

Not Applicable

SEQUENCE LISTING, A TABLE, OR A COMPUTER PROGRAM

Not Applicable

FIELD OF THE INVENTION

This invention relates generally to a device configured to prevent the waste of water within a toilet by activating the water shut off in the event of faulty or stuck toilet flop. More particularly, the device of the present disclosure provides a redundant system to prevent water leakage. In one aspect, the device of the present disclosure is a toilet fill valve having a tank or reservoir surrounding the fill valve and configured to activate the shut-off switch when the main toilet malfunctions.

BACKGROUND

A toilet is configured with several devices, mechanisms, and features to provide for the disposal of waste deposited within a bowl of the toilet. Generally, most toilets utilize a flush mechanism that includes a flop, a flush valve, a fill valve, and a float. In a typical flush, a full tank is emptied by raising the flop to open the flush valve, wherein water from the tank enters the bowl to flush the contents. Upon exit of the water from the tank, the fill valve is opened, and supply water is directed into both the tank and bowl for refilling, rinsing the bowl, and sealing the trap. As water is emptied from the tank and into the bowl for refilling, the float will rise with the increase of water into the tank and close the fill valve when the water in the tank is at the proper level.

It is well known that this traditional mechanism, while it is useful, is prone to waste water when malfunctioning, as water will continue to flow into the bowl or into an overflow tube if the fill valve does not close properly. Generally, this may be the result of an improper float or a flop that isn't sealing properly.

Therefore, there exists a need for an improved toilet device and method that is specifically configured to close the fill valve and save water upon a malfunction. Preferably this solution and method is provided in the form of a fill valve with a supplemental tank assembly that is easy to use, does not change bathroom aesthetics, and is configured for easy installation and use.

BRIEF SUMMARY OF THE INVENTION

The disclosure of the present application provides for a fill valve with a tank or a fill valve with a built-on tank that is fitted on a fill valve below the float and the shut of mechanism and generally referred to herein as the fill valve with tank device. Preferably, this fill valve with a tank device is generally a modification of an existing fill valve assembly and provides a redundant system for closing the fill valve even if a float or flop malfunctions during use of a toilet.

The fill valve of the present disclosure is configured to operate in concert with the existing toilet parts, wherein it can be easily added as an aftermarket assembly or integrated directly into a new and modified fill valve structure. Generally, the function of the fill valve with tank is to provide an assembly that somewhat mirrors the traditional toilet features for ease of use and assembly.

The improved flush assembly generally referred to herein as a fill valve tank and within the present description as the device. The device may alternately be referred to as the fill valve with built in tank to indicate that the features of the device may be provided in an assembly that is integrated directly into a fill valve as opposed to an add-on assembly to an existing fill valve. The features and structures of the device can be both provided in this stand-alone assembly or integrated assembly without departing from the spirit of the invention.

The device is configured for placement over a fill valve to surround the fill valve and float portion and is configured to shut off the fill valve even when water is leaking from the tank to the bowl as a result of an improper float or flop seal within the toilet tank. Accordingly, the device functions as a redundant system to prevent the waste of water from a leaking toilet flush assembly. The device is comprised of a housing, referred to as the fill valve tank and generally forming a tank-like structure configured for surrounding the fill valve in a coupling along an exterior portion of the fill valve. The housing having an open top side, a plurality of sidewalls, and a bottom connected to the plurality of sidewalls and configured for selective sealing and holding a fluid, such as water within a toilet tank, within an interior space of the housing. The housing sidewalls having a height that extends from the bottom to a position slightly above the water shutoff level that generally surrounds the entirety of the float and shutoff mechanism of the fill valve.

The housing bottom includes a bore generally being an aperture having a size to be sealed by a secondary flop, wherein the bore is selectively sealed by the secondary flop in a coupling with the flush lever through a secondary chain. The secondary chain generally mirroring the function of the main chain of the toilet flush mechanism, wherein the secondary chain moves in concert with a main chain to manipulate both a main flop and the secondary flop during a flush.

The bottom further including a central aperture positioned at a center of the bottom and generally having a size selected to accommodate a diameter of the fill valve of the toilet. In a first embodiment of the device utilized as a stand-alone device and configured as an attachment to an existing fill valve, this central aperture is aligned with a stem functioning to aid in attachment of the device and housing to the fill valve. The stem generally extending downward from the bottom opposite the interior and including a threaded portion along an exterior of the stem. The stem generally configured to closely surround the fill valve with the threaded portion providing an engagement surface to secure the device to the fill valve. Accordingly, the threaded portion can be secured with a corresponding nut and washer comprising a resilient material, such as, but not limited to rubber, silicone, or plastic surrounding the exterior of the fill valve to provide a coupling between the device and the fill valve. The resilient washer is placed within an interior surface of the nut to capture the washer between the nut and fill valve exterior to provide a generally water-tight seal. This assembly allows for the device to be placed in the desired position along the fill valve and accommodates adjustment to ensure the device is placed at the proper level and position relative to the water with the toilet tank.

The device will include a secondary water supply tube generally functioning similar to the existing water supply for the toilet and wherein this secondary water supply tube is configured to direct supply water into the interior space of the housing for generally filling this interior space after a flush. Accordingly, this secondary water supply tube may be fitted to the existing water supply tube through the use of a Y-shaped or T-shaped connector wherein the secondary water supply tube is generally a bifurcation of the main water supply. Much like a traditional water supply tube, this secondary water supply tube may include a clip member to secure the secondary water supply tube within the interior space of the housing so as to direct supply water into the interior space.

During a standard toilet flush in a toilet utilizing the device, the flush lever will manipulate both the main flop and the secondary flop to open the respective aperture and bore and drain retained water from both the toilet tank and the housing interior. After movement of water from these respective tanks, the main flop and the secondary flop will move to seal the bore and aperture of the toilet tank while supply water is introduced into the main toilet tank and the housing through the water supply tube and secondary water supply tube in coupling with the fill valve. As the fill valve supplies water and the water level increases within the tank and the housing the float is lifted to shut off the water and cease further filling. In the event the main flop does not seal properly, and water is not properly shut off, water will continue to fill the housing. As water fills the housing it will also have the ability to manipulate the float and shut off the water supply. Accordingly, the device will prevent the continued flow of water into the tank and bowl and provide a redundant water shut off mechanism.

In an alternate embodiment of the assembly of the device, the device features are integrated directly into an existing fill valve, wherein the housing is generally an extension of the fill valve surrounding the float and including all of the features of the device with the exception of the nut, washer, and stem. In this assembly, the device may be more useful as a completely new flush valve having features to prevent the leakage of water from the main tank due to a faulty flop or flop seal.

Generally, operation of the device will be unnoticed in a working toilet. In the event of a leaking toilet (tank not sealed allowing water to be wasted due to an improper flop seal or flop/chain mechanism malfunction), the device secondary flop will close and seal the bore, refill water will be directed into the fill valve tank housing, where it will be retained by the sidewalls and bottom and sealed bore; this filling of water within the housing will force the float upwards until the shutoff valve is closed. Accordingly, this device and overall system will prevent leakage and save water.

The invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

DETAILED DESCRIPTION OF THE INVENTION

Figure 1:
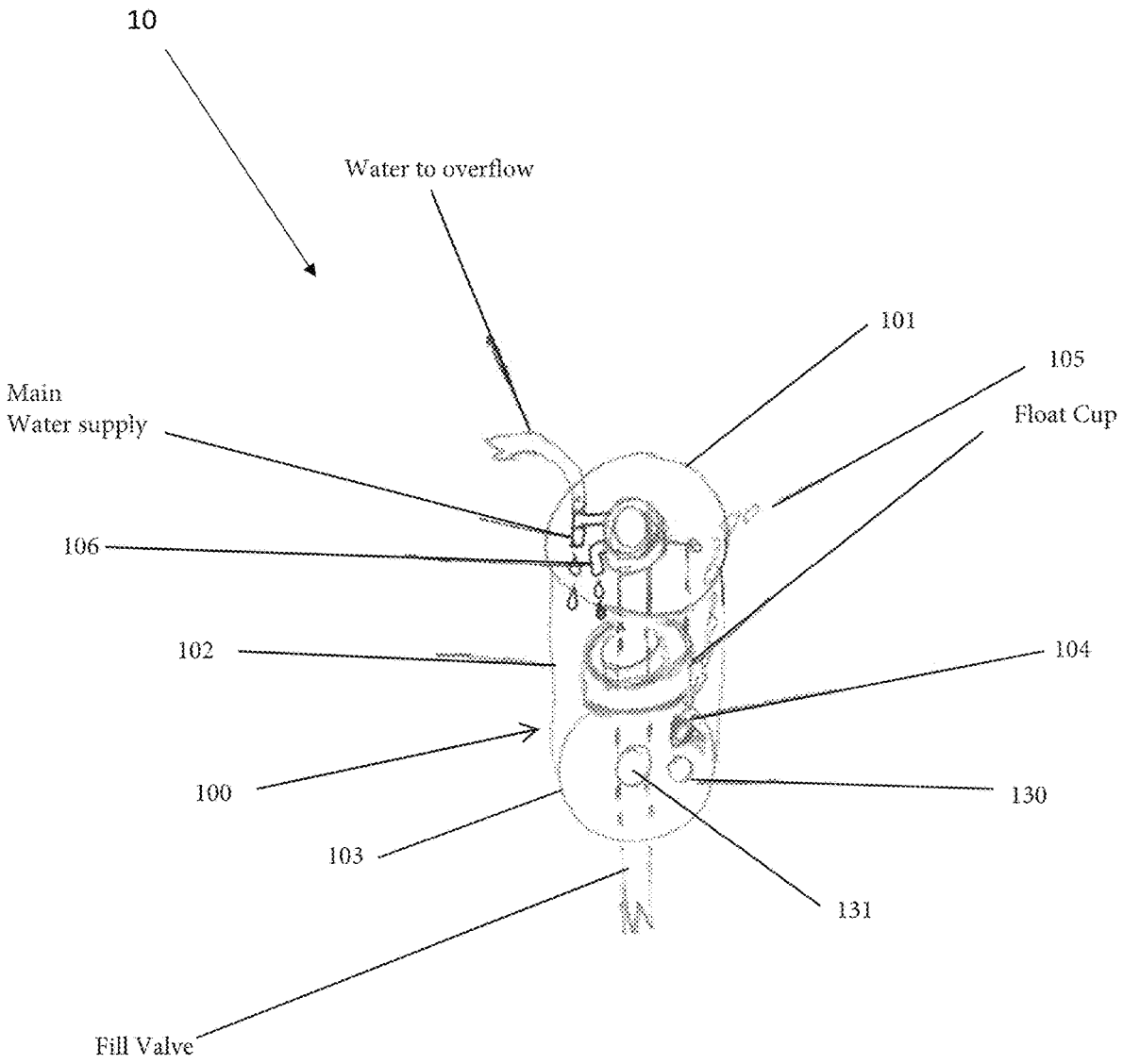
FIG. 1 is an isometric view and brief description of parts for the fill valve with tank device, according to the present disclosure.
Figure 2:
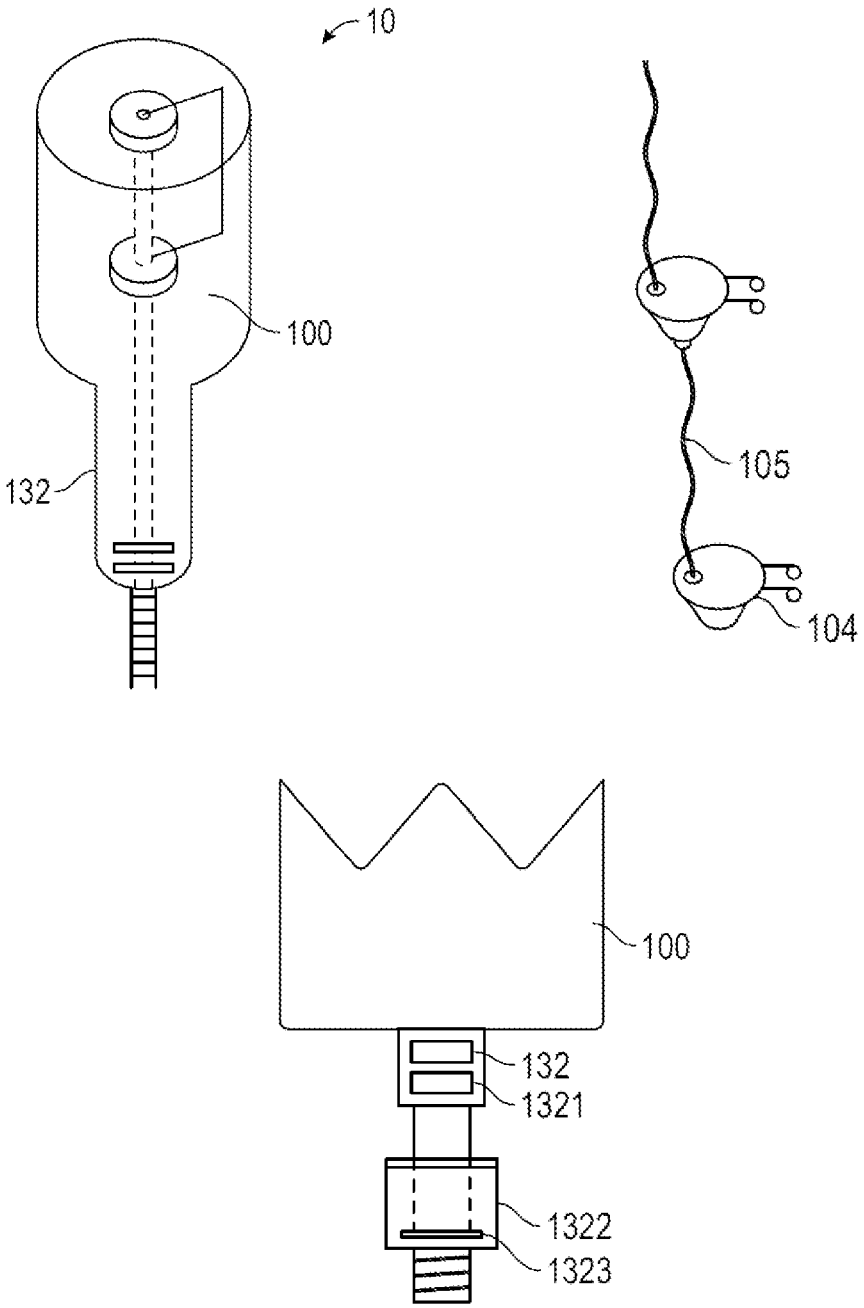
FIG. 2 is various views of alternate embodiments and assemblies of the fill valve with tank device, according to the present disclosure.

The following detailed description includes references to the accompanying drawings, which forms a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense.

Before the present invention of this disclosure is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the disclosure made herein.

Unless otherwise indicated, the words and phrases presented in this document have their ordinary meanings to one of skill in the art. Such ordinary meanings can be obtained by reference to their use in the art and by reference to general and scientific dictionaries.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "and/or" refers to any one of the items, any combination of the items, or all of the items with which this term is associated.

As used herein, the singular forms "a," "an," and "the" include plural reference unless the context clearly dictates otherwise.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances.

Furthermore, the recitation of one or more preferred embodiments does not imply that other embodiments are not useful and is not intended to exclude other embodiments from the scope of the invention.

As used herein, the terms "front," "back," "rear," "upper," "lower," "right," and "left" in this description are merely used to identify the various elements as they are oriented in the FIGS, with "front," "back," and "rear" being relative to the apparatus. These terms are not meant to limit the elements that they describe, as the various elements may be oriented differently in various applications.

As used herein, the term "coupled" means the joining of two members directly or indirectly to one another. Such joining may be stationary in nature or movable in nature. Such joining may be achieved with the two members, or the two members and any additional intermediate members being integrally formed as a single unitary body with one another or with the two members or the two members and any additional intermediate members being attached to one another. Such joining may be permanent in nature or alternatively may be removable or releasable in nature. Similarly, coupled can refer to a two member or elements being in communicatively coupled, wherein the two elements may be electronically, through various means, such as a metallic wire, wireless network, optical fiber, or other medium and methods.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

Referring now to FIGS. 1-4 of the present disclosure most generally related to a toilet flush assembly having features to prevent water waste and leakage from a toilet tank to bowl due to a faulty flush valve or toilet flop assembly. The improved flush assembly generally referred to herein as a fill valve tank and within the present description as the device 10. The device 10 may alternately be referred to as the fill valve with built in tank to indicate that the features of the device 10 may be provided in an assembly that is integrated directly into a fill valve as opposed to an add-on assembly to an existing fill valve. The features and structures of the device 10 can be both provided in this stand-alone assembly or integrated assembly without departing from the spirit of the invention.

The device 10 is generally configured for placement over a fill valve to surround the fill valve and float portion and is configured to shut off the fill valve even when water is leaking from the tank to the bowl as a result of an improper float or flop seal within the toilet tank. Accordingly, the device 10 functions as a redundant system to prevent the waste of water from a leaking toilet flush assembly. The device 10 is comprised of a housing 100, referred to as the fill valve tank and generally forming a tank-like structure configured for surrounding the fill valve in a coupling along an exterior portion of the fill valve. The housing 100 having an open top side 101, a plurality of sidewalls 102, and a bottom 103 connected to the plurality of sidewalls 102 and configured for selective sealing and holding a fluid, such as water within a toilet tank, within an interior space of the housing 100. The housing 100 sidewalls 102 having a height that extends from the bottom 103 to a position slightly above the water shutoff level that generally surrounds the entirety of the float and shutoff mechanism of the fill valve.

The housing 100 bottom 103 includes a bore 130 generally being an aperture having a size to be sealed by a secondary flop 104, wherein the bore 130 is selectively sealed by the secondary flop 104 in a coupling with the flush lever through a secondary chain 105. The secondary chain 105 generally mirroring the function of the main chain of the toilet flush mechanism, wherein the secondary chain 105 moves in concert with a main chain to manipulate both a main flop and the secondary flop 104 during a flush.

The bottom 103 further including a central aperture 131 positioned at a center of the bottom 103 and generally having a size selected to accommodate a diameter of the fill valve of the toilet. In a first embodiment of the device 10 utilized as a stand-alone device and configured as an attachment to an existing fill valve, this this central aperture 131 is aligned with a stem 132 functioning to aid in attachment of the device 10 and housing 100 to the fill valve. The stem 132 generally extending downward from the bottom 103 opposite the interior and including a threaded portion 1321 along an exterior of the stem 132. The stem 132 generally configured to closely surround the fill valve with the threaded portion 1321 providing an engagement surface to secure the device 10 the fill valve. Accordingly, the threaded portion 1321 can be secured with a corresponding nut 1322 and resilient washer 1333 surrounding the exterior of the fill valve to provide a coupling between the device 10 and the fill valve. The resilient washer 1333 is placed within an interior surface of the nut 1322 to capture the washer 1333 between the nut 1322 and fill valve exterior to provide a generally water-tight seal. This assembly allows for the device 10 to be placed in the desired position along the fill valve and accommodates adjustment to ensure the device 10 is placed at the proper level and position relative to the water with the toilet tank.

The device 10 will include a secondary water supply tube 106 generally functioning similar to the existing water supply for the toilet and wherein this secondary water supply tube 106 is configured to direct supply water into the interior space of the housing 100 for generally filling this interior space after a flush. Accordingly, this secondary water supply tube 106 may be fitted to the existing water supply tube through the use of a Y-shaped or T-shaped connector 1061 wherein the secondary water supply tube 106 is generally a bifurcation of the main water supply. Much like a traditional water supply tube, this secondary water supply tube 106 may include a clip member to secure the secondary water supply tube 106 within the interior space of the housing 100 so as to direct supply water into the interior space.

To better explain the function and operation of the device 10 it may be helpful to describe the features and structures during assembly, placement, and use. Accordingly, the device 10 is placed in coupling with the fill valve along an exterior surface by first placing the nut 1322 around the fill valve exterior with an interior of the nut 1322 aligned to capture the engagement surface in the form of the threaded portion 1321 of the stem 132. Prior to placement of the housing 100 of the device 10, the washer 1333 is placed around the fill valve tube and seated within the nut 1322 interior to form a water-tight connection. The housing 100 stem 132 is placed over the fill valve tube by aligning the central aperture 131 with the fill valve and sliding the device 10 over the fill valve and securing the device 10 in the proper position with the sidewall 102 height slightly above the water shut off position. The secondary chain 105 is then affixed to the flush lever and adjusted to manipulate the secondary flop 104, wherein the secondary flop 104 is lifted to drain water from the housing 100 during a flush. In addition to the affixing the secondary chain 105, the secondary water supply 106 is fixed in alignment with the housing 100 interior, wherein the secondary water supply 106 introduces water into the housing 100 interior after a flush to generally add water to the housing 100 for manipulating the float and ceasing water flow if necessary.

During a standard toilet flush in a toilet utilizing the device 10, the flush lever will manipulate both the main flop and the secondary flop 104 to open the respective aperture and bore 130 and drain retained water from both the toilet tank and the housing 100 interior. After movement of water from these respective tanks, the main flop and the secondary flop 104 will move to seal the bore 130 and aperture of the toilet tank while supply water is introduced into the main toilet tank and the housing 100 through the water supply tube and secondary water supply tube 106 in coupling with the fill valve. As the fill valve supplies water and the water level increases within the tank and the housing 100 the float is lifted to shut off the water and cease further filling. In the event the main flop does not seal properly, and water is not properly shut off, water will continue to fill the housing 100. As water fills the housing 100 it will also have the ability to manipulate the float and shut off the water supply. Accordingly, the device 10 will prevent the continued flow of water into the tank and bowl and provide a redundant water shut off mechanism.

In an alternate embodiment of the assembly of the device 10, the device 10 features are integrated directly into an existing fill valve, wherein the housing 100 is generally an extension of the fill valve surrounding the float and including all of the features of the device 10 with the exception of the nut 1322, washer 1333, and stem 132. In this assembly, the device 10 may be more useful as completely new flush valve having features to prevent the leakage of water from the main tank due to a faulty flop or flop seal.

Generally, operation of the device 10 will be unnoticed in a working toilet. In the event of a leaking toilet (tank not sealed allowing water to be wasted due to an improper flop seal or flop/chain mechanism malfunction), the device 10 secondary flop 104 will close and seal the bore 103, refill water will be directed into the fill valve tank housing 100, where it will be retained by the sidewalls 102 and bottom 103 and sealed bore 103; this filling of water within the housing 100 will force the float upwards until the shutoff valve is closed. Accordingly, this device 10 and overall system will prevent leakage and save water.

Figure 3:
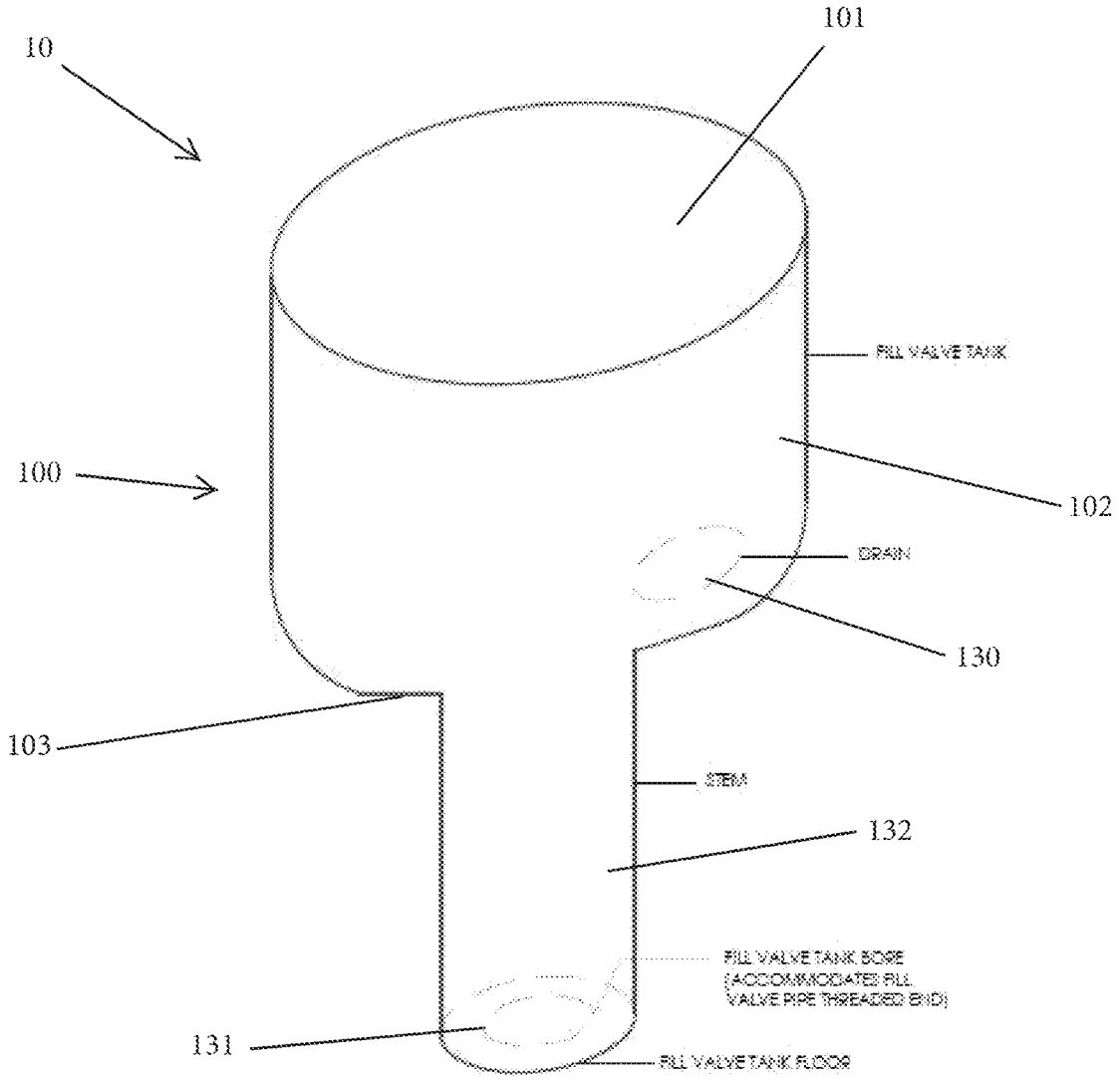
FIG. 3 is an isometric view of a housing related to an alternate embodiment of the device, according to the present disclosure.
Figure 4:
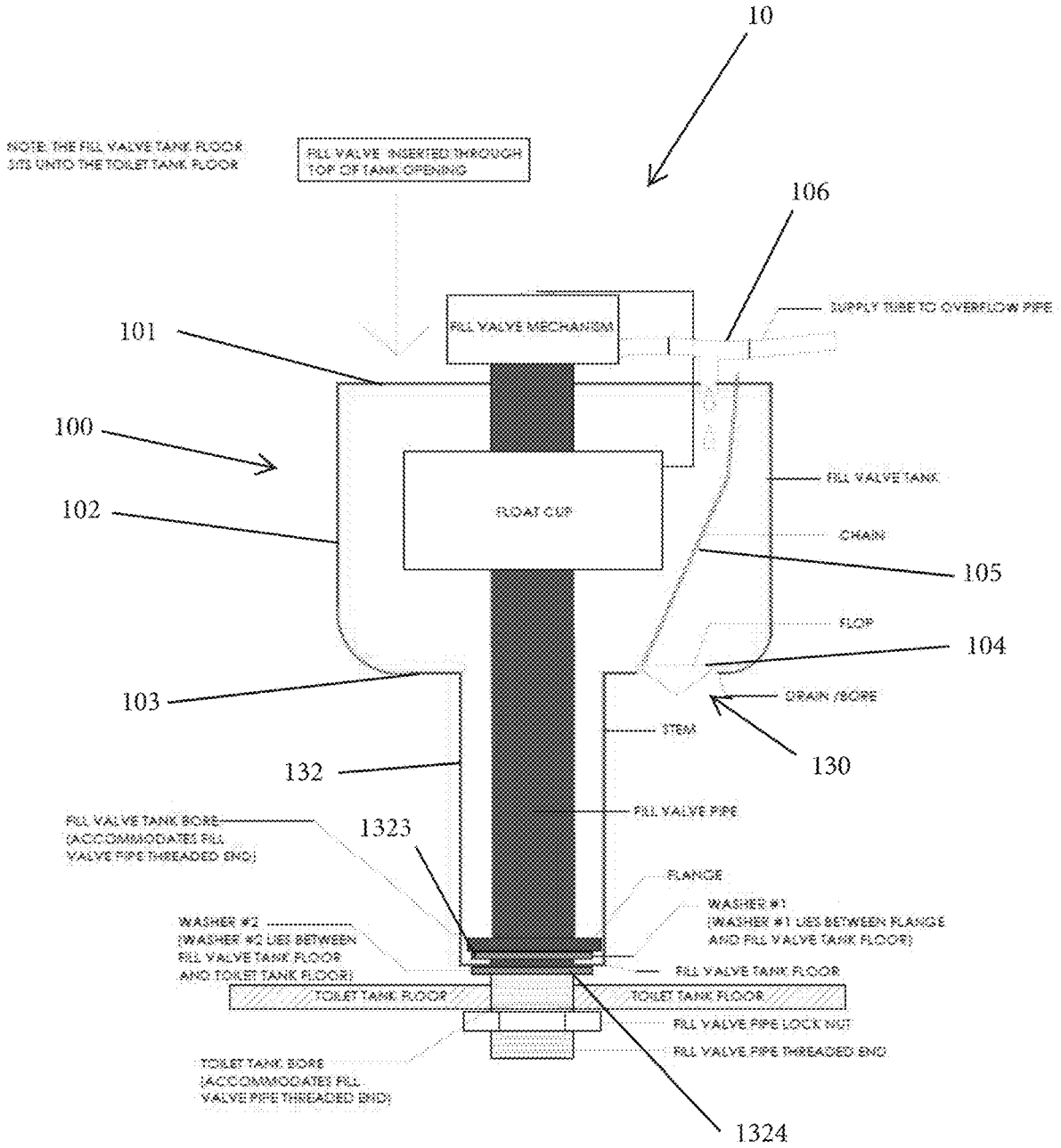
FIG. 4 is a cross sectional view of the alternate embodiment of FIG. 3 shown in an assembly with a fill valve of a toilet, according to the present disclosure.

Referring now to FIGS. 3-4 an alternate embodiment of the device 10 is disclosed. This device 10 assembly generally utilizes an alternate housing 100 shape to allow for fitment to an existing fill valve, wherein the connection of the device 10 to the fill valve occurs at a bottom wall of the toilet tank. In this embodiment the housing 100 generally includes the stem 132 aligned with the central aperture 131, but does not utilize exterior threads 1321. Rather, the device 10 in this embodiment is specifically sized to utilize the assembly features of a fill valve. Accordingly, fitment with this embodiment of the device 10, will generally be preassembled prior to placement within the toilet tank, wherein the housing 100 open top side is generally placed on the fill valve from the bottom up. The housing 100 central aperture will utilize the existing flange of the fill valve and a resilient washer 1323 placed between the fill valve flange and bottom of the housing 100. A second resilient washer 1324 will be placed on the exterior of the housing 100 between the housing 100 and toilet tank floor. The device 10 will then be secured by securing the fill valve to the toilet tank floor; this assembly will generally capture the housing 100 between the fill valve flange and tank bottom; similar to the installation of a fill valve into a toilet. The device 10 will include the additional features of the secondary flop (not pictured), secondary chain (not pictured), bore (not pictured), and secondary water supply (not pictured).

While the invention has been described above in terms of specific embodiments, it is to be understood that the invention is not limited to these disclosed embodiments. Upon reading the teachings of this disclosure many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

What is claimed is:

1. A device to prevent the flow of water from a fill valve having a float within a tank of a toilet having a water supply tube due to a failure of a main flop, a chain, or a flush lever, the device comprising:

a housing, the housing having a size to at least completely surround the float and a portion of the fill valve to generally encapsulate water within an interior space, the housing comprising:

a bottom having a central aperture and a bore;

a plurality of sidewalls coupled to the bottom and extending a height opposite the bottom;

an open top portion, the open top portion culminating at an end of the height of the plurality of sidewalls and defining the interior space;

a secondary flop, the secondary flop positioned on the bottom of the housing and sized for receipt in and for sealing the bore;

a secondary chain, the secondary chain coupled to the secondary flop and the flush lever, wherein manipulation of the flush lever is translated through the secondary chain to the secondary flop for opening and sealing the bore; and a secondary water supply tube, the secondary water supply tube coupled to the water supply tube and affixed adjacent to the open top portion, wherein water from the water supply tube is directed into the secondary water supply and into the interior of the housing during filling of the toilet tank, wherein the central aperture is sized to receive the fill valve and allow a watertight coupling between the housing and the fill valve.

2. The device as in claim 1, wherein the bottom includes a stem, the stem aligned with the central aperture and extending downward opposite the open top portion, the stem having an exterior the exterior configured to accept a nut and a resilient washer for coupling the device to the fill valve.

3. The device as in claim 2, wherein the exterior of the stem is threaded.

4. The device as in claim 1, wherein the housing is generally cylindrical in shape.

5. The device as in claim 1, wherein the housing is integrated into the structure of the fill valve.

6. A redundant system in the form of a device to prevent a toilet from leaking, the device configured to prevent the unnecessary flow of water from a fill valve having a float within a tank of a toilet, the device comprising:

a cylindrical housing, the cylindrical housing having a size to at least completely
surround the float and a portion of the fill valve to encapsulate water within an interior space of the housing, the housing comprising:
a bottom having a central aperture in communication with a stem and a bore;
a plurality of sidewalls coupled to the bottom and extending a height opposite the bottom;
an open top portion, the open top portion culminating at an end of the height of the plurality of sidewalls and defining the interior space;

a secondary flop, the secondary flop received on the bottom of the housing adjacent the bore and sized for receipt within the bore for sealing the bore;

a secondary chain, the secondary chain coupled to the secondary flop and a flush lever, wherein manipulation of the flush lever is translated through the secondary chain to the secondary flop for selectively opening and sealing the bore; and a secondary water supply tube, the secondary water supply tube coupled to a water supply tube and affixed adjacent to the open top portion, wherein water from the water supply tube is directed into the secondary water supply and into the interior of the housing during filling of the toilet tank, wherein the central aperture and stem are sized to receive the fill valve and allow a watertight coupling between the housing and the fill valve.

7. The device as in claim 6, wherein the stem extends downward opposite the open top portion, the stem having an exterior the exterior configured to accept a nut and a resilient washer for coupling the device to the fill valve.

8. The device as in claim 7, wherein the exterior of the stem is threaded.

9. The device as in claim 6, wherein the housing is integrated into the structure of the fill valve.

10. A fill valve tank device configured to prevent a toilet from leaking due to a faulty flop or flop seal preventing movement of a float in communication with a shut-off mechanism of a fill valve, the device configured to prevent the unnecessary flow of water from a fill valve having a float within a tank of a toilet, the fill valve tank device comprising:

a housing, the housing integrated into the fill valve, the housing having a size to
at least completely surround the float and a portion of the fill valve to encapsulate water within an interior space of the housing, the housing comprising:
a bottom having a bore;
a plurality of sidewalls coupled to the bottom and extending a height opposite the bottom;
an open top portion, the open top portion culminating at an end of the height of the plurality of sidewalls and defining the interior space;

a secondary flop, the secondary flop received on the bottom of the housing
adjacent the bore and sized for receipt within the bore for sealing the bore;

a secondary chain, the secondary chain coupled to the secondary flop and a flush
lever, wherein manipulation of the flush lever is translated through the secondary chain to the secondary flop for selectively opening and sealing the bore; and a secondary water supply tube, the secondary water supply tube coupled to a
water supply tube and affixed adjacent to the open top portion, wherein water from the water supply tube is directed into the secondary water supply and into the interior of the housing during filling of the toilet tank.

11. The device as in claim 10, wherein the housing is generally cylindrical in shape.

* * * * *